US005243662A

United States Patent [19]

Sogn et al.

[11] Patent Number: 5,243,662

[45] Date of Patent: Sep. 7, 1993

[54] ELECTRODYNAMIC SOUND GENERATOR FOR HEARING AIDS

[75] Inventors: Bjørn Sogn, Oslo; Asbjørn Krokstad; Jarle Svean, both of Trondheim, all of Norway

[73] Assignee: NHA A/S, Stabekk, Norway

[21] Appl. No.: 781,149

[22] PCT Filed: Jul. 5, 1990

[86] PCT No.: PCT/NO90/00111

§ 371 Date: Dec. 31, 1991

§ 102(e) Date: Dec. 31, 1991

[87] PCT Pub. No.: WO91/01075

PCT Pub. Date: Jan. 24, 1991

[30] Foreign Application Priority Data

Jul. 6, 1989 [NO] Norway ..... 892811

[51] Int. Cl.[5] ..... H04R 25/00

[52] U.S. Cl. ..... 381/201; 381/194

[58] Field of Search ..... 381/194, 201, 202

[56] References Cited

U.S. PATENT DOCUMENTS

| | | | |
|---|---|---|---|
| 2,551,447 | 5/1951 | Marquis | 179/119 |
| 4,320,263 | 3/1982 | Thiele | 179/115.5 |
| 4,380,689 | 4/1983 | Giannetti | 179/114 R |
| 4,742,887 | 5/1988 | Yamagishi | 181/129 |
| 4,752,963 | 6/1988 | Yamazaki et al. | 381/193 |

FOREIGN PATENT DOCUMENTS

| | | | |
|---|---|---|---|
| 2913644 | 10/1980 | Fed. Rep. of Germany . | |
| 3048779 | 9/1981 | Fed. Rep. of Germany . | |
| 0076897 | 5/1985 | Japan | 381/194 |
| 1159081 | 7/1969 | United Kingdom . | |

*Primary Examiner*—Jin F. Ng
*Assistant Examiner*—Sinh Tran
*Attorney, Agent, or Firm*—Millen, White, Zelano, & Branigan

[57] ABSTRACT

A miniaturized electrodynamic sound generator comprises a diaphragm, a permanent magnet with pole pieces, a magnet yoke, and a coil. The yoke is designed such that is constitutes a housing or a cabinet of the sound generator. The permanent magnet and the pole pieces are provided in a recess in the cabinet or the yoke and surrounded by the coil, which is connected to the diaphragm at a peripheral area thereof. The diaphragm is provided above the magnet system of the recess and fastened to the outside of the cabinet. The dynamic response of the sound generator is determined by the magnetic, electrical, mechanical, and acoustic parameters which are used in the design of the sound generator. By varying some of these parameters, the frequency and amplitude of a resonance may be chosen such that the sound generator may reconstruct the natural acoustic transfer function in the range of 2–4 kHz in the human meatus. This makes the sound generator particularly suitable for use in hearing aids.

5 Claims, 4 Drawing Sheets

ELECTRODYNAMIC SOUND GENERATOR FOR HEARING AIDS

The present invention concerns a miniaturized, electrodynamic sound generator, especially for hearing aids and with a diaphragm essentially formed as a spherical cap segment, a permanent magnet with pole pieces, a magnet yoke and a coil, arranged as stated in the preamble of claim 1. The sound generator according to the invention is intended for placement in the meatus of an adult human being.

An open electrodynamic sound generator with small dimensions, suitable for use in heat- or earphones e.g. for music reproduction, is known from U.S. Pat. No. 4,472,887. By the sound generator disclosed in this patent the damping of resonance in the range 3–5 kHz is especially emphasized for in this way to achieve a better quality of sound reproduction. Another electrodynamic sound generator, particularly in form of a small loudspeaker for use in headphones or a microphone, is know from De-OS 30 48 779 and discloses a magnet system which concentrically surrounds an air gap, wherein a oscillating coil is provided, attached to the diaphragm. A miniaturized electrodynamic sound generator for hearing aids is shown in U.S. Pat. No. 4,380,689. The miniaturization is hereby achieved in that the magnet does not surround the iron core, but is provided at its side around the same axis as the core. A miniaturized electrodynamic sound generator for use in hearing aids has also been developed by the firm Westra Electronic GmbH of Germany. This sound generator has a frequency range from 20 to 20,000 kHz and very small dimensions, viz. a diameter of 5.5 mm and a length of 5.5 mm, but is still too large to be easily located in the human meatus.

It is known that the meatus of humans has an acoustic resonance which generates a peak in the frequency response for the acoustic amplification of the sound pressure from the ear opening and to the tympanus. The frequency and amplitude of the resonance peak vary individually, but usually it is located within the range of 2 kHz to 4 kHz and has an amplitude of 10– 15 dB. Such an increase of the amplification in this range is very important for how the sound is perceived and the individuals's perception of sound quality. If the meatus is closed by a hearing aid plug, the individual who wears the hearing aid looses the resonance in this important frequency range.

Electrical filtering of the input signal to the sound generator in a hearing aid may be used in order to restore the desired frequency response. Using electrical filtering is however connected with a number of disadvantages, as the necessary electrical components need a lot of space, consume electrical power and adds up to an expensive addition. The need for space and the consumption of power are especially detrimental for hearing aids which shall have small dimensions and are powered by a small battery.

The object of the present invention is to provide an electrodynamic sound generator of very small dimensions in order that it can be located in the meatus near the tympanus and is designed such that its main resonance falls in the frequency range of interest, that is 2–4 kHz, and which further has an acoustic attentuation such that the desired meatus resonance may be recreated. Another object of the sound generator according to the invention is that is shall be employed in a hearing aid which does not close the meatus in order that a possible hearing residue at low frequencies is taken care of.

These objects are achieved with an electrodynamic sound generator according to the present invention and with features disclosed by the appended claims.

The electrodynamic sound generator according to the invention will be described in greater detail below in connection with an exemplifying embodiment and with reference to the accompanying drawing.

FIG. 1*a* shows an electrodynamic sound generator according the invention.

FIG. 2*a* shows a diagrammatical plan view of the cabinet or the yoke of the sound generator of FIG. 1, seen from below.

FIG. 2*b* shows a diametrical section through the cabinet or the yoke.

Figure 1A:
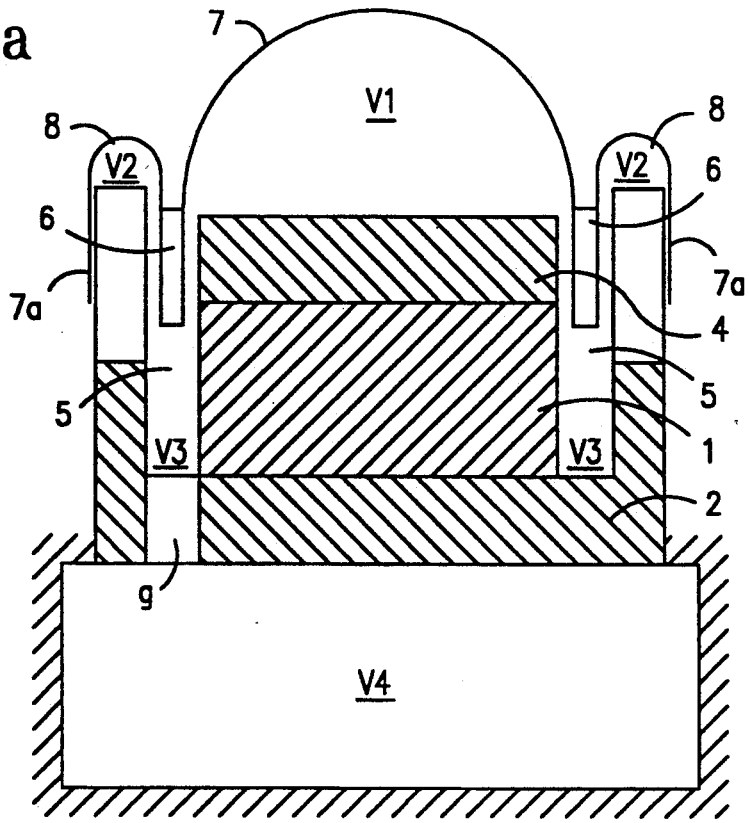
Figure 2A:
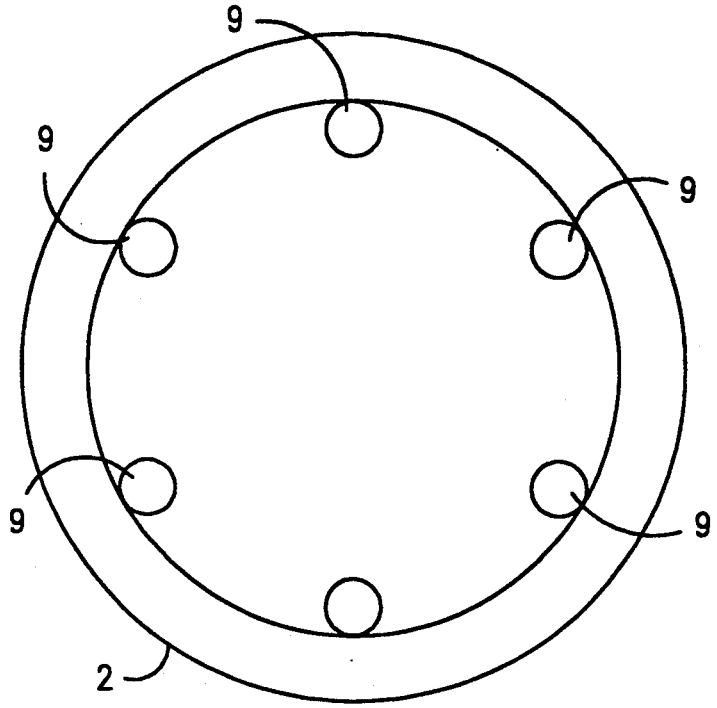
Figure 2B:
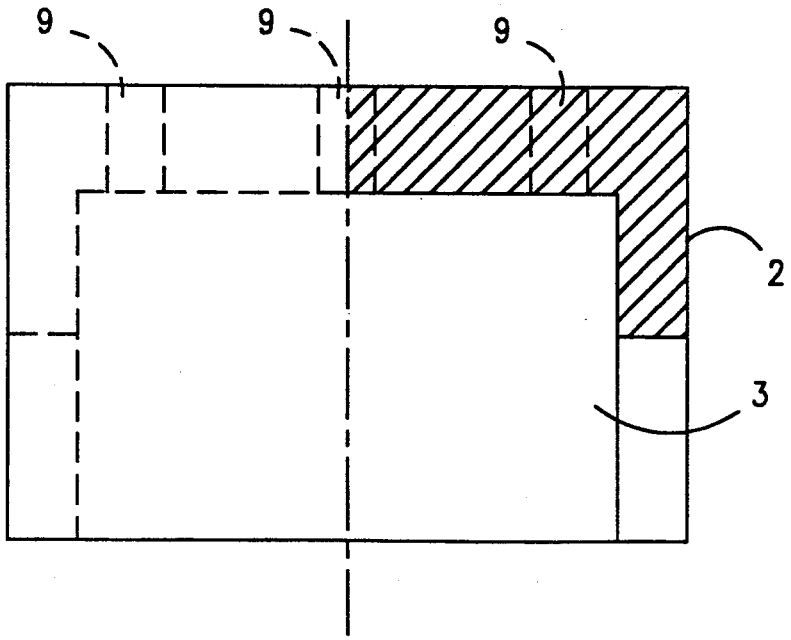

FIG. 1*a* shows a sound generator with a permanent magnet 1 of "Vacodym 335 HR". The magnet has been placed in a cabinet or a housing of "Vacofer S2" which provides the yoke 2 of the magnet. The yoke 2 is here designed as a cylindrical box and the magnet 1 located centrically in a cylindrical recess 3 in this box. The recess 3 has greater diameter than that of the magnet such that a concentric clearance 5 is formed between the magnet and the wall of the recess, which in its turn is a part of the side wall of the box or yoke. The bottom of the recess 3 and hence the yoke 2 constitutes a first pole piece 2 of the magnet, whereas on the opposite side of the magnet another pole piece 4 or "Vacofer S2" with the same diameter as the magnet is provided. The permanent magnet 1 has typically a diameter of 2.9 mm and a length 1.5 mm. In the upper part of clearance 5 and around the second pole piece 4 and possibly the upper part of the magnet 1 there is provided a coil 6, for instance of 35 micrometer copper wire with a length of about 0.87 m and a total of 85 turns distributed in four layers of 21 turns. The diameter of the coil is 3.2 mm and the length 1 mm, while the thickness of the coil is about 0.2 mm. It is thus provided in the upper portion of the clearance 5 between the magnet system and the recess wall. The coil 6 whose resistance is 17Ω, is connected electrically by wires not shown. Further the coil 6 is attached to the margin of a diaphragm 7 which above the second pole piece 4 forms an approximate spherical cap segment, such that between the second pole piece 4 and the diaphragm 7 an approximately semispherical volume V1 is enclosed. The diaphragm 7 has been manufactured by hot air forming of a 40 micrometer thick film or polycarbonate and is thinnest near the margin and at top of the cap where the thickness is about 20 micrometers. The cap-like portion of the diaphragm 7 is attached to the coil 6 on the top of the clearing 5 and on the outside of the coil the diaphragm has been bent upwards and above a upper end side of the yoke wall to form a circular channel 8 with approximately semicircular section over the side surface of the yoke wall. On the outside of the yoke 2 the diaphragm 7 is bent down and attached to the outer wall of the yoke. As shown in FIG. 2*a*, the recess 3 is connected to the bottom side of the cabinet or the yoke 2 by in this case six throughgoing openings in form of holes 9 with a circular section. On the bottom side or as one may prefer, the backside of the cabinet or the yoke, it may be assigned the sound generator a back volume V4 which in a strict structural sense is not a part of the sound generator, but provided in this way yet becomes a part of the sound generator3 s acoustic design. This back volume V4 may most simply be created when the sound generator is located in a hearing aid for insertion in the meatus, as the connection between other portions of the hearing aid and the sound generator is made in such a way that a back volume of the disclosed type, for instance with a volume of 56 $mm^3$, is formed. The holes 9 which ventilate the clearance V3 under the coil, have a diameter of 0.4 mm.

According to the invention the resonance of the sound generator is determined by the effective mass of the coil 6, the effective mass of the diaphragm 7, the stiffness of the diaphragm suspension *7a*, the effective inertance (defined as the mass of the clearance or volume divided by the product of its area and the square of its length) $R_1$ or the air in the clearance 5 between the coil 6 and the inside of the recess wall and the effective inertance $R_2$ of the air in the clearance 5 between the coil 6 and the second pole piece 4 respectively the magnet 1, the effective inertance $R_3$ of the air in the holes 9, and the effective inertances of the volume V1 below the diaphragm cap, the volume V2 of the channel which the diaphragm 7 forms above the upper end surface of the yoke wall, the volume V3 of the cavity or the clearance 5 below the coil and the volume V4 of the optional back volume By adjusting the values for these parameters mutually it is possible to keep the resonance within for instance the desired frequency range between 2 kHz and 4 kHz.

Figure 3:
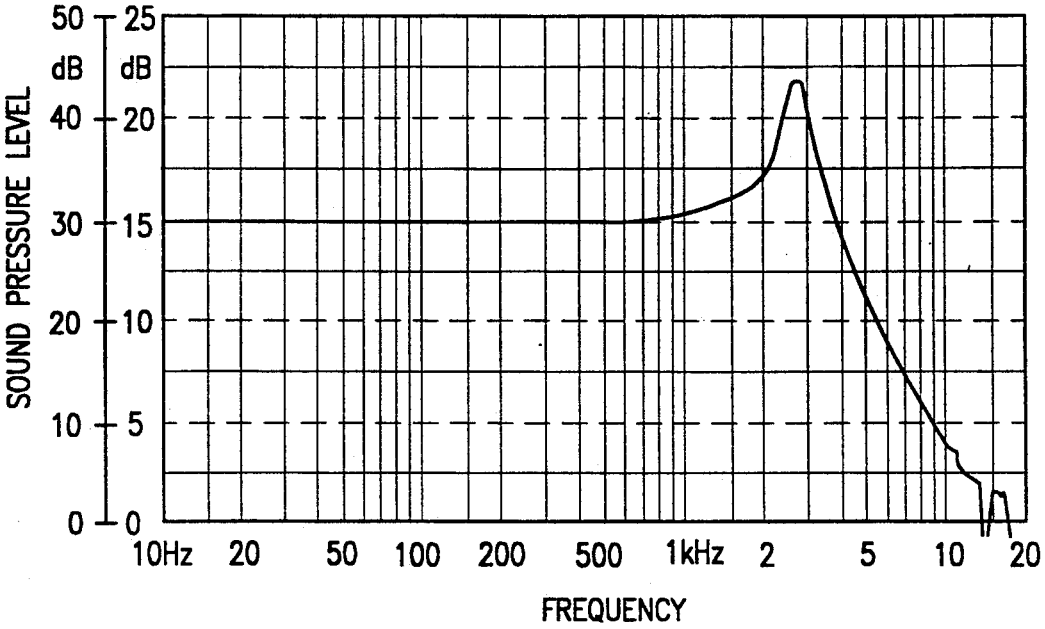
FIG. 3 shows the graph of the frequency response of the sound generator.

FIG. 3 shows the frequency response of the sound generator in FIG. 1 measured in a tight coupler with a volume of 430 $mm^3$. As seen from FIG. 3, the sound generator has a practically straight frequency response from below 10 kHz and up to 1 kHz. The sensitivity as 1 kHz was 26 dB re 1 Pa/V and the maximum sound pressure at 1 kHz was more than 115 dB SPL. The total harmonic distortion was less than 1% at a sound pressure of 100 dB. The sound generator had a resonance peak at 2.6 kHz, that is in the range most advantageous for the hearing. The unattentuated resonance amplitude was in the present case closer to 25 kB, but was during the measurement acoustically dampened to a more suitable level of 13 dB.

As can be seen from FIG. 3, the sound generator functions as a low pass filter, i.e. it mainly eliminates the frequency components in the range from 3–4 kHz and upwards. Obviously that is really not desirable as speech sound contains important frequency components in the following octave band. Response roll-off is however in normal after a resonance peak in a sound generator and may in any case be compensated to some extent by a treble control of the hearing aid which employs the sound generator of the present invention.

Figure 1B:
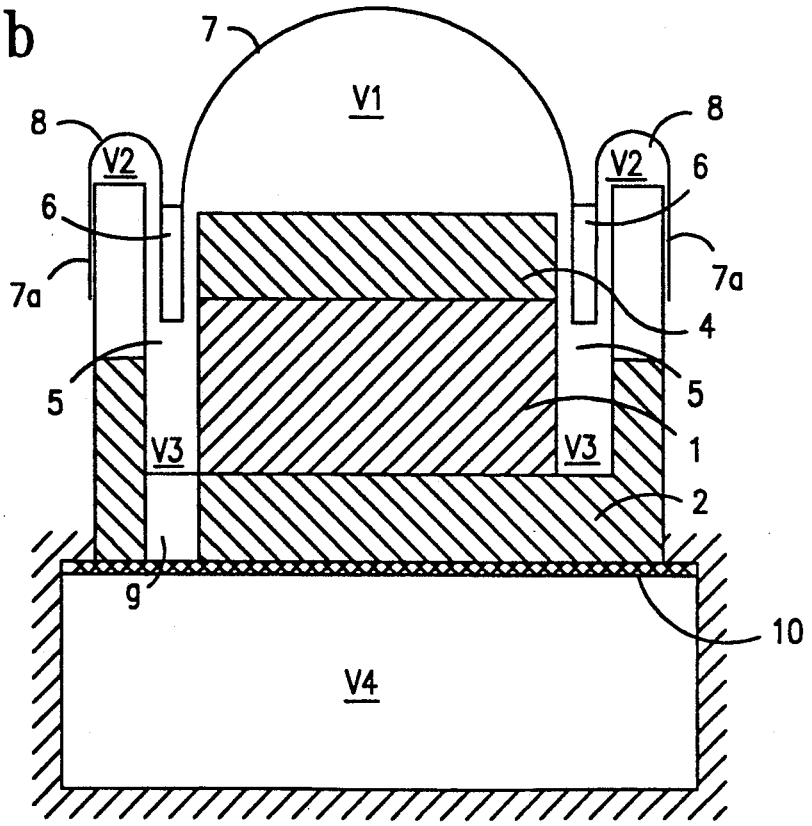
Figure 1C:
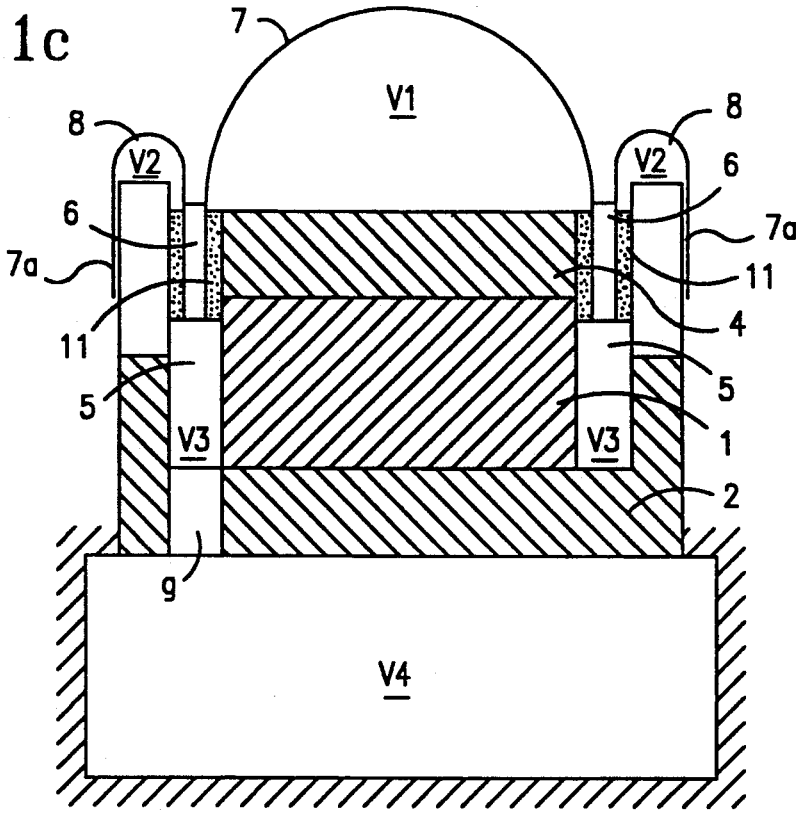
Figure 1D:
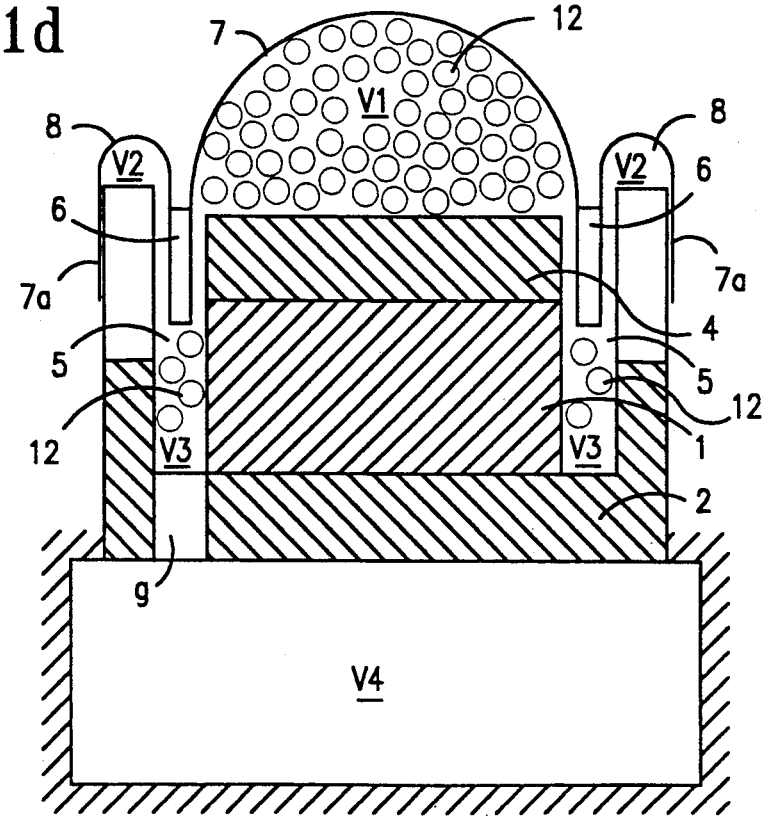

As mentioned, it is desired to attenuate the resonance peak somewhat and this is in the present invention achieved by providing a cloth 10, FIG. 1*b*, of fine meshed nylon above the openings of the underside of the sound generator. It is, however, also possible to achieve a corresponding damping of the resonance peak by for instance providing ferrofluid 11, FIG. 1*c*, in the air gap of the magnet, or applying monodisperse particles ("Ugelstad spheres") 12, FIG. 1*d*, in the cavities V1 and V3 and/or V4. As monodisperse particles of this king have exactly the same dimensions and shape, a certain number of particle provided in a given geometrical configuration may give a exactly specifiable and reproducible acoustic damping.

Figure 4:
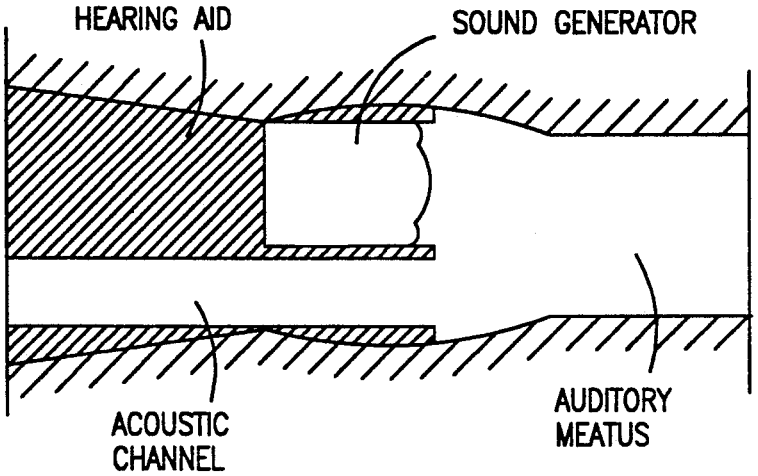
FIGS. 4 and 5 show diagrammatically different possibilities for the sound generator of FIG. 1 implemented in an acoustic filter in the meatus.
Figure 5:
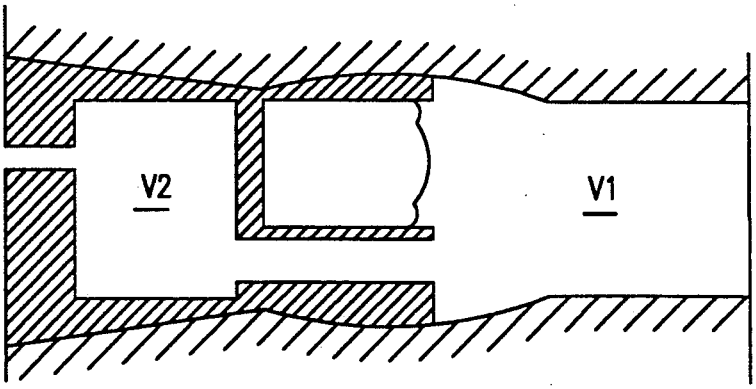

The sound generator according to the invention has in the example of the embodiment a diameter of 4.5 mm and will hence not close the meatus which has an effective diameter of about 7 mm. In FIG. 4 the sound generator is shown provided in e.g. a hearing aid and inserted in the meatus about 10 mm from the tympanus which is located to the right. The hearing aid does not close the meatus, but is ventilated by an opening to the tympanus of for instance an equivalent diameter of 3 mm, something which is possible due to the small diameter of the sound generator. Accordingly it is possible to apply the sound generator in a hearing aid which exploits a possible low frequency hearing residue of the user. In the configuration of FIG. 4 the sound generator in connection with the opening through the hearing aid and the volume at the tympanus functions simultaneously as a combined transducer and acoustic filter in the meatus.

It is to be understood that the described instance of an embodiment in no way limits the scope and frame of the invention, but that the sound generator according to the invention may be designed with other materials than those specified here and similarily being adapted such that the response curve may have a different path than the one shown here.

Persons skilled in the art will easily recognize that a miniaturized sound generator of this kind also may be employed for different purposes than in hearing aids and possibly with a more or less attentuated resonance amplitude, while the resonance determining parameters actually also may be chosen such that the resonance peak has another frequency than the one being most relevant when the sound generator only is to be used in a hearing aid.

Finally it may be remarked that the natural meatus response has a frequency and an amplitude which varies from person to person. When the sound generator is to be used in a hearing aid it is hence of course an advantage that the sound frequency response of the sound generator to the largest degree possible is adapted to the natural acoustic transfer function of he user's meatus. It is, however, no absolute demand that the sound generator must be completely individually tuned, as it has been shown sufficient that it has a frequency response which only approximately must correspond to the natural transfer function of the meatus. It is of course nothing against that a number of a series of the sound generator may be manufactured with somewhat varying response characteristics, but for persons skilled in the art it will also be possible to conceive different methods of implementing some form or other of resonance tuning. It is here only pointed to the possibility of controlling or adjusting the suspension stiffness of the diaphragm or for instance adjusting the dimension of one or more of the volumes V1, V3 or V4.

We claim:

1. A miniaturized electrodynamic sound generator, particularly for hearing aids, comprising a diaphragm (7) substantially formed as a spherical cap segment, a permanent magnet (1) with pole pieces (2, 4), a first pole piece comprising a magnet yoke (2) and a coil (6), wherein below the caplike diaphragm, a permanent magnet is provided in the yoke, wherein the yoke (2) is shaped as a cylindrical cabinet with a cylindrical recess for locating the magnet, the bottom of the recess (3) forming said first pole piece on a bottom side of the magnet (1) and the recess (3) having a diameter which is greater than that of the magnet, forming a concentric clearance (5) between and around the magnet and the recess wall, wherein a second pole piece (4) is provided on a top side of the magnet and between the magnet and the diaphragm cap and surrounded by the coil (6) which is located in an upper portion of the clearance (5) and attached to the diaphragm (7) around the margin of the cap, wherein the diaphragm (7) is extended further above the clearance and bent over an upper end surface of the recess wall to be supported on the outer surface of the yoke (2) such that the diaphragm (7) forms a concentric channel (8) around the cap and with an approximately semicircular section above said upper end surface, wherein, between the clearance (5) and a bottom side of the yoke (2) at least one throughgoing opening (9) is provided, and wherein the sound generator has a resonance which essentially is determined by the values of the following parameters:

(a) effective mass of the coil, (b) effective mass of the diaphragm, (c) the stiffness of the diaphragm suspension, (d) effective inertance $R_1$ or the air of the clearance (5) between the coil (6) and the inside of the recess (3) wall and effective inertance $R_2$ of the air in the clearance (5) between the coil (6) and the second pole piece (4) of the magnet (1), said clearances constituting the air gap of the magnet (1), (e) effective inertance $R_3$ or the air in the opening or the openings (9) between the clearance (5) and the bottom side of the yoke (2), (f) effective inertances of the volume V1 between the second pole piece (4) and the diaphragm cap, the volume V2 in the channel (8) which the diaphragm (7) forms over the upper end surface of the recess (3) wall, the volume V3 of the clearance (5) under the coil (6), said parameters having such values that the resonance lies between 2 kHz and 4 kHz, thus corresponding to the resonance of the open meatus of an adult human being.

2. The sound generator according to claim 1, wherein a fine-meshed cloth of textile is provided above the at least one throughgoing opening.

3. The sound generator according to claim 1, wherein a ferrofluid is provided in the clearance on both sides of the coil (6).

4. The sound generator according to claim 1 wherein monodisperse particles are provided in the volumes B1 and B3.

5. The sound generator according to claim 1 wherein the diameter at most is 4.5 mm and the length exclusive of the optional back volume at most is 4.75 mm.

* * * * *